US009495563B2

(12) United States Patent
Ziemba et al.

(10) Patent No.: US 9,495,563 B2
(45) Date of Patent: Nov. 15, 2016

(54) ANALOG INTEGRATOR SYSTEM AND METHOD

(71) Applicant: Eagle Harbor Technologies, Inc., Seattle, WA (US)

(72) Inventors: Timothy Ziemba, Bainbridge Island, WA (US); Kenneth E. Miller, Seattle, WA (US); John G. Carscadden, Seattle, WA (US); James Prager, Seattle, WA (US); Ilia Slobodov, Seattle, WA (US);
(Continued)

(73) Assignee: Eagle Harbor Technologies, Inc., Seattle, WA (US)

( * ) Notice: Subject to any disclaimer, the term of this patent is extended or adjusted under 35 U.S.C. 154(b) by 0 days.

(21) Appl. No.: 14/296,137

(22) Filed: Jun. 4, 2014

(65) Prior Publication Data

US 2014/0354343 A1 Dec. 4, 2014

Related U.S. Application Data

(60) Provisional application No. 61/831,051, filed on Jun. 4, 2013.

(51) Int. Cl.
*G06G 7/18* (2006.01)

(52) U.S. Cl.
CPC ..... *G06G 7/18* (2013.01)

(58) Field of Classification Search
CPC ..... G06G 7/00; G06G 7/18; G06G 7/184; G06G 7/186; G11C 7/00; G11C 7/1078; G11C 7/1084
USPC ..... 327/334, 337, 339, 341–345, 365, 518, 327/597, 595, 603
See application file for complete search history.

(56) References Cited

U.S. PATENT DOCUMENTS 5,392,043 A * 2/1995 Ribner ..... H03M 3/342 341/143
6,577,135 B1 6/2003 Matthews et al.
(Continued)

FOREIGN PATENT DOCUMENTS

EP 1 515 430 A1 3/2005

OTHER PUBLICATIONS

International Search Report and Written Opinion mailed dated Sep. 15, 2014 as received in PCT Application No. PCT/US2014/04029.

*Primary Examiner* — John Poos
*Assistant Examiner* — David Mattison
(74) *Attorney, Agent, or Firm* — Maschoff Brennan

(57) ABSTRACT

Systems and methods are disclosed to integrate signals. Some embodiments include an integrator comprising an active input; a passive input; a first integrator having a first integrator input and a first integrator output; a second integrator having a second integrator input and a second integrator output; a first plurality of switches coupled with the first integrator input, the second integrator input, the active input, and the passive input; a second plurality of switches coupled with the first integrator output and the second integrator output; and a controller. The controller may be configured to control the operation of the first plurality of switches to switch the active input between the first integrator input and the second integrator input, and control the operation of the first plurality of switches to switch the passive input between the first integrator input and the second integrator input.

16 Claims, 12 Drawing Sheets

(72) Inventors: Daniel Edward Lotz, Woodinville, WA (US)

(56) References Cited

U.S. PATENT DOCUMENTS

| | | | | |
|---|---|---|---|---|
| 6,741,120 | B1 * | 5/2004 | Tan | H03H 11/1291 327/554 |
| 7,061,230 | B2 * | 6/2006 | Kleine | G01D 3/028 324/207.16 |
| 8,773,184 | B1 * | 7/2014 | Petrov | H03L 7/093 327/148 |
| 2003/0169107 | A1 | 9/2003 | LeChevalier | |
| 2008/0062733 | A1 | 3/2008 | Gay | |
| 2013/0113650 | A1 | 5/2013 | Behbahani et al. | |

* cited by examiner

ANALOG INTEGRATOR SYSTEM AND METHOD

FIELD

This disclosure relates generally to analog integrator systems and methods.

BACKGROUND

An integrator is a device to perform the mathematical operation known as integration. Integrators are used in a number of settings to sample data over periods of time. Integrators may be employed by laboratory equipment, test equipment, medical devices, etc. A number of different integrator circuits are known in the art.

SUMMARY

Systems and methods are disclosed to integrate signals. Some embodiments include an integrator comprising an active input; a passive input; a first integrator having a first integrator input and a first integrator output; a second integrator having a second integrator input and a second integrator output; a first plurality of switches coupled with the first integrator input, the second integrator input, the active input, and the passive input; a second plurality of switches coupled with the first integrator output and the second integrator output; and a controller. The controller may be configured to control the operation of the first plurality of switches to switch the active input between the first integrator input and the second integrator input, and control the operation of the first plurality of switches to switch the passive input between the first integrator input and the second integrator input.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Systems and methods are disclosed to integrate an input signal. Some embodiments described herein may integrate the input signal by switching between two integrators.

The present disclosure is directed towards an integrator circuit or system that may include multiple integrators that are stable on relatively short time scales, and that also may be utilized for relatively long time scale integration. Over long periods of time, for example, integrators may drift, which may result in integration error. To overcome this drift, among other things, the integrators may be switched between active and passive loads so that, while one integrator is integrating the active load, the other integrator may be reset when integrating the passive load. The resistance, inductance, and/or capacitance of the active load and the passive load may be identical or substantially identical (within 1%, 2%, 5%, or 10% of each other, or within manufacturing tolerances), while the active load provides a voltage and/or current signal and the passive load does not. In some embodiments, an additional circuit may be placed at the output of the integrator pair such that an output from multiple integrator pairs may be averaged to achieve better or increased performance.

In some embodiments, switches may be selected so that most or all charge injection and/or leakage currents are balanced, both during and between switching events. Accordingly, respective switches may be paired and balanced with each other. In part, this may be realized by the use of what would otherwise appear to be switches without purpose but are switching between a pair of resistors each tied to circuit ground. In some embodiments, all integrators, as well as, for example, the integrator input coil, may see identical input loads and/or output loads so, from the perspective of the integrators, those integrators do not respond or change states as if they normally would when being switched. Rather, everything is balanced and appears constant in time. Part of this may include balancing any delay(s) generated in gate/drive logic, and may involve the use of additional drive logic and gates that would otherwise appear to be without purpose.

Although not so limited, an appreciation of the various aspects of the present disclosure may be gained from the following discussion in connection with the drawings.

Figure 1:
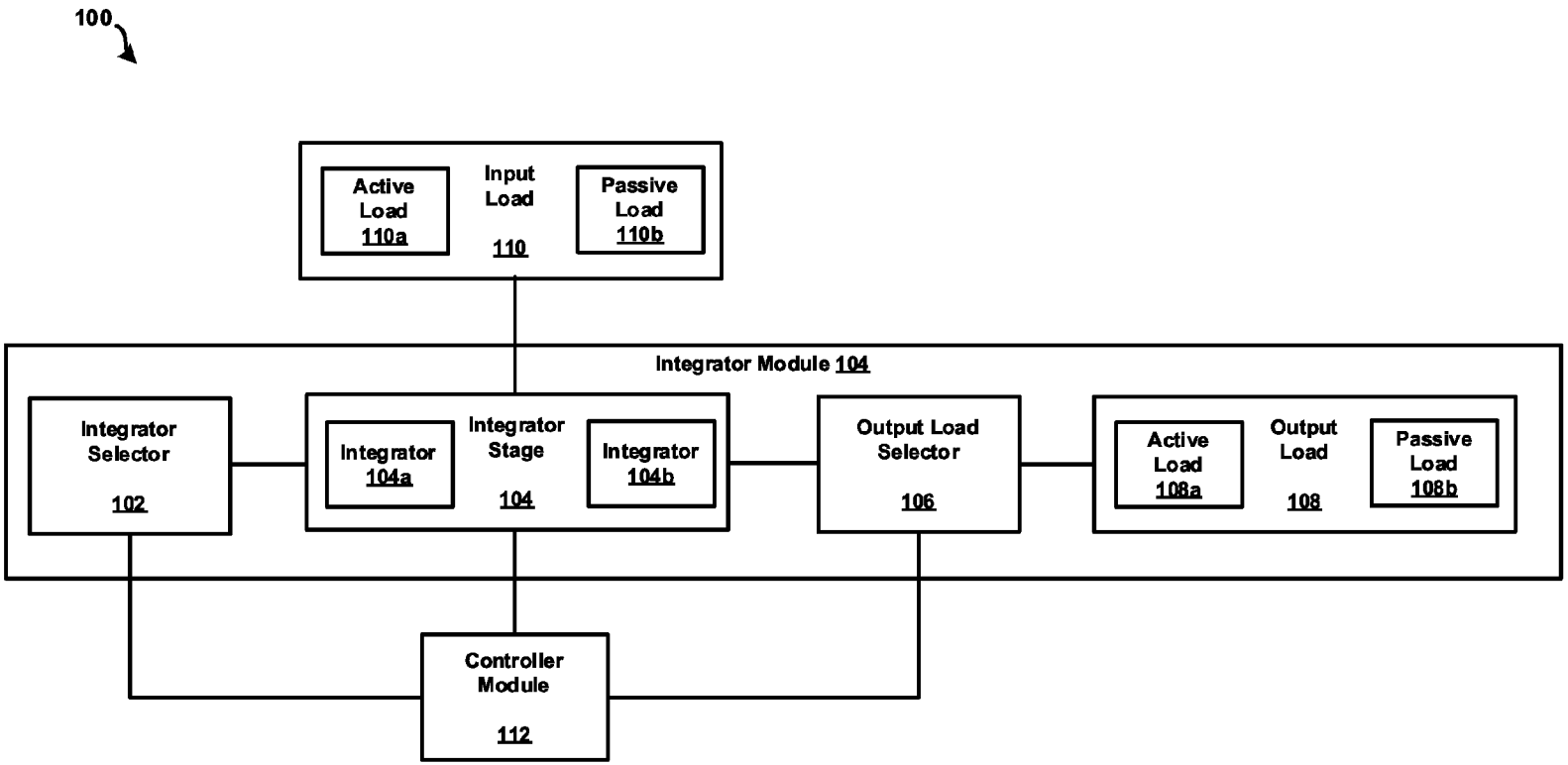
FIG. 1 illustrates an example integrator circuit according to some embodiments described herein.

FIG. 1 illustrates an example integrator system 100 according to some embodiments described herein. The integrator system 100 may include an input load 110, an integrator module 114, a controller module 112, and an output load 108. In this example, the integrator module 114 may include an integrator selector 102, an integrator stage 104, an output load selector 106, and the output load 108. The integrator module 114 may include a first integrator 104*a* and a second integrator 104*b*. The input load 110 may include an active input load 110*a* and a passive input load 110*b*. The output load 108 may include an active output load 108*a* and a passive output load 108*b*. Other embodiments are possible than that shown in FIG. 1, and further such embodiments may be implementation-specific. For example, in applications that call for more than a pair of integrators, in some embodiments, the integrator stage 104 may include more integrators as desired.

The first integrator 104*a* and/or the second integrator 104*b* may include any device, component, integrated circuit, etc. that integrates or performs the mathematical operation of integration on an incoming signal. The first integrator 104*a* and/or the second integrator 104*b*, for example, may include a voltage integrator or a current integrator. A voltage integrator, for example, may perform time integration of an input signal of an electric voltage and/or may measure electric flux. A current integrator, for example, may perform time integration of an input signal of an electrical current and/or may measure total electric charge. The current integrator, for example, may be a charge amplifier.

The active input load 110*a* may include any device from which data may be sampled. For example, the active input load 110*a* may include a signal from any measurement device (or sample) from which a voltage and/or current may be integrated. For example, the measurement device may include a detector such as a high energy particle physics detector, a magnetic field detector, a scientific experiment detector, a linear accelerator detector, etc. As another example, the measurement device may include any medical device such as a magnetic resonance image machine, medical imager, nuclear medicine functional imaging, positron emission topology, etc. Any number of other devices requiring integration of a signal may be used.

Generally speaking, and as described in more detail below, the first integrator 104*a* and the second integrator 104*b* may be switched so that one of the two integrators is integrating the active input load 110*a* while the other integrator is sampling the passive input load 110*b*. To accomplish this, the controller module 112, among other things, may control the action of the integrator selector 102 and/or the output load selector 106 to switch which integrator is integrating the active input load 110*a* and the passive input load 110*b*. In this way, the first integrator 104*a* and the second integrator 104*b* may each partially sample the active input load 110*a*. In some embodiments and as discussed in more detail below, the controller module 112 may combine the data (and/or signals) from the first integrator 104*a* and the second integrator 104*b*.

The controller module 112 may also control load selector inputs to the first integrator 104*a* and the second integrator 104*b* so that each integrator switches between integrating the active input load 110*a* and the passive input load 110*b*. Because the active input load 110*a* includes the signal that is being sampled, each integrator partially integrates the desired signal.

The controller module 112 may be coupled to at least the integrator selector 102, the integrator stage 104, and the output load selector 106 of the integrator module 114. In some embodiments, the controller module 112 may control the integrator selector 102 to select which one of the first integrator 104*a* and the second integrator 104*b* is coupled to a corresponding one of the active input load 110*a* and the passive input load 110*b*. When coupled thereto, the active input load 110*a* or the passive input load 110*b* may provide a load to one of the first integrator 104*a* and the second integrator 104*b*. The controller module 112 may further control the output load selector 106 to select which one of the active output load 108*a* and the passive output load 108*b* is coupled to a corresponding one of the first integrator 104*a* and the second integrator 104*b*. When coupled thereto, the active output load 108*a* or the passive output load 108*b* corresponds to a load to either the first integrator 104*a* or the second integrator 104*b*.

The controller module 112, for example, may control the output load selector 106 so that the corresponding one of the first integrator 104*a* and the second integrator 104*b* that is currently coupled to the active input load 110*a* is in turn coupled to the active output load 108*a*. The controller module 112, for example, may control the output load selector 106 so that the corresponding one of the first integrator 104*a* and the second integrator 104*b* that is currently coupled to the passive input load 110*b* is in turn coupled to the passive output load 108*b*.

Figure 12:
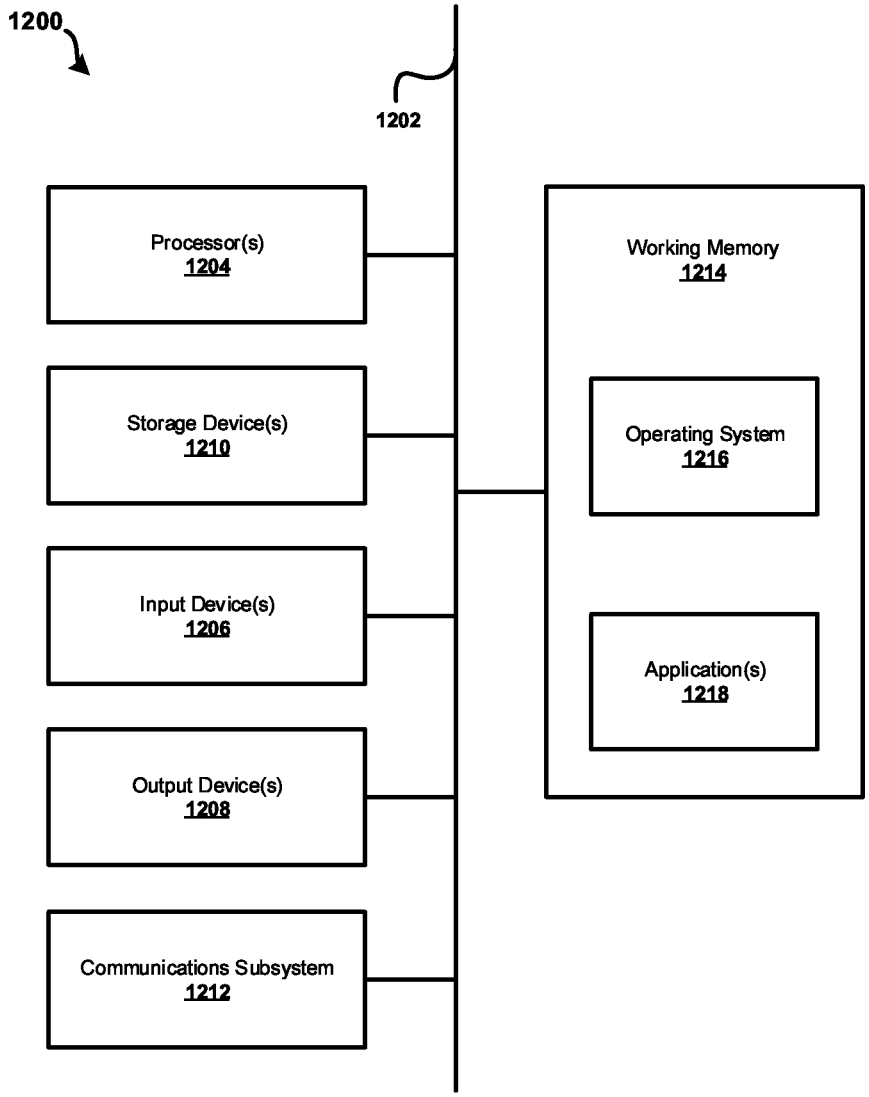
FIG. 12 illustrates an example computing system or device according to some embodiments described herein.

In some embodiments, the controller module 112 may include any type of controller or processor such as, for example, the computational system 1200 shown in FIG. 12, an integrated circuit, a field-programmable array (FPGA), a general-purpose computer, a microcontroller, etc. In some embodiments, the controller module 112 may be programmed to control the operation of any components, processes, methods, devices, components, etc. described herein.

In some embodiments, the controller module 112, the integrator selector 102, and/or the output load selector 106 may be combined into one or more controllers or processors such as, for example, the computational system 1200 shown in FIG. 12, an integrated circuit, a field-programmable array (FPGA), a general-purpose computer, a microcontroller, etc.

The final loop may calculate and/or apply the slanted baseline correction to remove any linear drift over long periods of time. When in pre-trigger mode, the last loop computes the slope of the data using a simple linear regression. Once triggered, this loop uses the previously calculated slope to apply a slanted baseline correction, which is subtracted from the data. The data is then sent to the host machine via four DMA FIFOs. The host then stores and/or graphs the data to the screen.

An example input/load State or configuration of the first integrator 104*a* and the second integrator 104*b* at a particular point in time is shown in table form as Table 1:

| | Active Input Load 110a | Passive Input Load 110b | Active Output Load 108a | Passive Output Load 108b |
|---|---|---|---|---|
| Integrator 104a | Coupled | Decoupled | Coupled | Decoupled |
| Integrator 104b | Decoupled | Coupled | Decoupled | Coupled |

Figure 2:
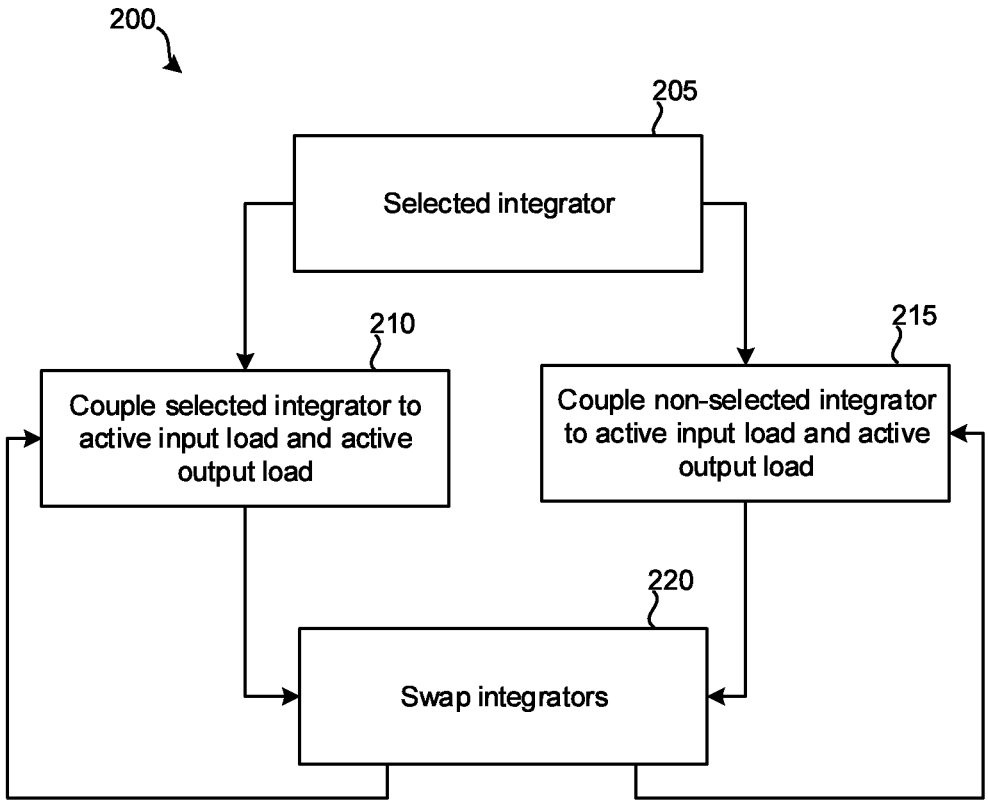
FIG. 2 is an example flowchart of a method for integrating a signal according to some embodiments described herein.

In FIG. 2, the one of the first integrator 104*a* and the second integrator 104*b* that is currently coupled to both the active input load 110*a* and the active output load 108*a* may be considered to be in an Active State as currently integrating the input signal from active load 104*a*. Conversely, the one of the first integrator 104*a* and the second integrator 104*b* that is currently coupled to both the passive input load 110*b* and the passive output load 108*b* may be considered to be in a Reset State as not currently integrating the active input load 110*a* and is instead is zeroing its output and stabilizing itself by being coupled with the passive input load 110*b*.

With reference to the Reset State, in some embodiments, the active input load 110*a* may take the form of an output from an electrical device to which it is desired to integrate the signal. The active input load 110*a*, for example, may exhibit particular impedance from the perspective of either the first integrator 104*a* or the second integrator 104*b* when coupled thereto. In some embodiments, the passive input load 110*b* may be selected so as to exhibit an impedance similar to that of the active input load 110*a* and/or without providing an active signal to sample when coupled to either one of the first integrator 104*a* and the second integrator 104*b*. In this manner, the input load to both the first integrator 104*a* and the second integrator 104*b* during operation or use may appear to be balanced and constant in time.

Further, in reference to the Reset State, in some embodiments the active output load 108*a* may take the form of an input to a digitizer such as, for example, an analog-to-digital converter. The active output load 108*a*, for example, may exhibit a particular impedance from the perspective of either the first integrator 104*a* or the second integrator 104*b* when coupled thereto. In some embodiments, the passive output load 108*b* may be selected so as to exhibit an impedance similar to that of the active output load 108*a* when coupled to either one the first integrator 104*a* and the second integrator 104*b*. In this manner, the output load of both the first integrator 104*a* and the second integrator 104*b* during operation or use may appear to be balanced and constant in time.

In some embodiments, the controller module 112 may be wholly or at least partially incorporated within the integrator module 114. In this embodiment, a process 200 may be wholly or at least partially implemented on or by the integrator module 114. Still other embodiments are possible.

FIG. 2 is a flowchart of the example process 200 of selecting which one of the first integrator 104*a* and the second integrator 104*b* is placed into the Active State and the Reset State At any particular point in time, according to at least one embodiment described herein. One or more blocks or steps of the process 200 may be implemented, in some embodiments, by one or more components of the controller module 112. Although illustrated as discrete blocks, various blocks may be divided into additional blocks, combined into fewer blocks, or eliminated, depending on the desired implementation.

The process 200 begins at block 205, where a particular one of the first integrator 104*a* and the second integrator 104*b* of the integrator module 114 may be selected (the "selected integrator") to monitor the active input load 110*a*.

At block 210, the integrator selector 102 and the output load selector 106 may be actuated substantially simultaneously so that the selected integrator is coupled to both the active input load 110*a* and the active output load 108*a*. In this configuration, the selected integrator may be considered to be in the Active State of operation. In parallel, at step 215, the integrator selector 102 and the output load selector 106 may be actuated substantially simultaneously so that the non-selected integrator is selected to monitor the passive input load 110*b* and is coupled to the passive output load 108*b*. In this configuration, the non-selected integrator may be considered to be in a Reset State of operation.

At step 220, the status of the first integrator 104*a* and the second integrator 104*b* may be swapped. For example, a different particular one of the first integrator 104*a* and the second integrator 104*b* of the integrator module 114 may be selected to monitor the active input load 110*a* (the "selected integrator").

The first integrator 104*a* and the second integrator 104*b* selection as the selected integrator may be swapped based upon any of one or more of a number of different factors or criteria. For example, selection of a different particular integrator may be based solely upon passage of a predetermined time period that represents an amount of time the originally selected integrator is maintained in the Active State of operation, such as about a 0.05-microsecond time period, about a 20-microsecond time period, about a 5-millisecond time period, about a 36-millisecond time period, etc. For example, the second integrator 104*b* may be selected at step 220 following operation of the first integrator 104*a* for or of about a 10-microsecond time period. In general, an example time period may range from about 1 nanosecond to about one day, and may include any other sub-range having any particular endpoint within this example time period. Other examples of time periods may be 1 microsecond, 10 microsecond, 1 millisecond, 100 millisecond, 1 second, and 10 seconds.

As another example, the first integrator 104*a* and the second integrator 104*b* selection as the selected integrator may be swapped based upon operating or operational status of the particular one of the first integrator 104*a* and the second integrator 104*b* as selected at block 205. For example, integration error of the particular integrator selected at block 205 may be monitored to determine or estimate when the integration error might exceed a predetermined and configurable maximum integration error threshold. In one embodiment, integration error may be defined as the absolute integrator drift in a given time span or period multiplied by the integrator RC time. In this manner, the different particular one of the first integrator 104*a* and the second integrator 104*b* may be selected prior to exceeding of maximum integration error of a currently active integrator.

In some embodiments, error may be introduced from any number of one or more sources such as, for example, input offset voltages, common-mode currents, contact potentials, and thermoelectric effects. An example benchmark of maximum integration error may include maximum integration error of 0.25 mV-s while operating over about a 3600-second time period, including all sources of error. Still other examples are possible. For example, the different particular one of the first integrator 104*a* and the second integrator 104*b* may be selected based upon multiple predefined and configurable criteria as desired.

As another example, the first integrator 104*a* and the second integrator 104*b* selection as the selected integrator may be swapped based upon operating or operational status of the particular one of the first integrator 104*a* and the second integrator 104*b* as selected at block 205. For example, integration error of the particular integrator selected at block 205 may be monitored to determine or estimate when the slope of integration drift might exceed a predetermined and configurable drift threshold.

Following block 220, flow within the process 200 may loop or branch back to block 210 and block 215. In this manner, continuous switching may be achieved as desired between the first integrator 104*a* and the second integrator 104*b* of the integrator module 114 to monitor the input load 110 of FIG. 1. The continuous switching between the first integrator 104*a* and the second integrator 104*b* of the integrator module 114 is further discussed in connection with FIG. 3.

Figure 3:
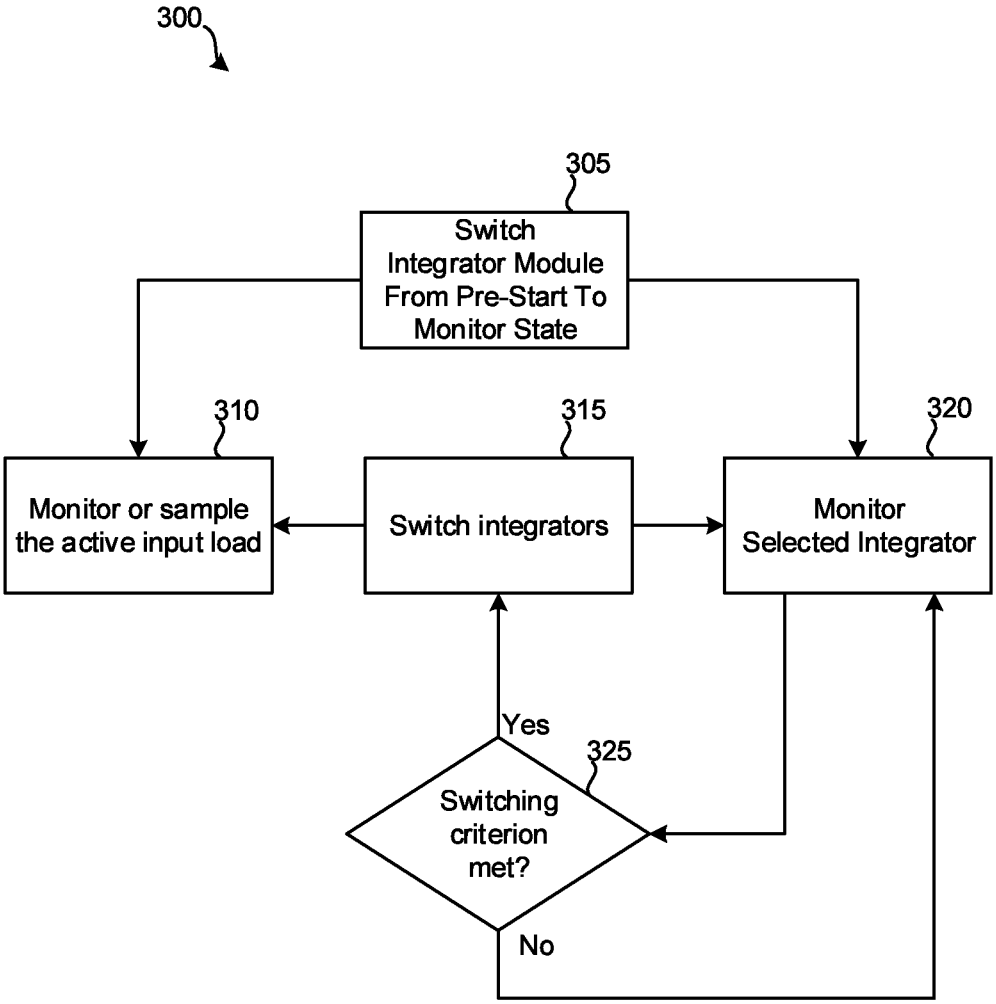
FIG. 3 is another example flowchart of a method for integrating a signal according to some embodiments described herein.

FIG. 3 is a flowchart of an example process 300 for selecting which one of the first integrator 104*a* and the second integrator 104*b* is placed into the Active State and the Reset State, according to at least one embodiment described herein. One or more blocks or steps of the process 300 may be implemented, in some embodiments, by one or more components of the controller module 112. Although illustrated as discrete blocks, various blocks may be divided into additional blocks, combined into fewer blocks, or eliminated, depending on the desired implementation.

The process 300 begins at block 305 where the integrator module 114 may be switched from a Pre-Start State to a Default Monitor State so that one of the first integrator 104*a* and the second integrator 104*b* may be selected to monitor the input load 110 of FIG. 1. In the Pre-Start State, for example, both the first integrator 104*a* and the second integrator 104*b* may be coupled with the passive input load 110*b*, and/or one of the first integrator 104*a* and the second integrator 104*b* may be coupled to the active output load 108*a* and the other coupled to the passive output load 108*b*. In some embodiments, each integrator may have a different input load with similar impedances to the active input load.} In this configuration, differential inputs of the first integrator 104*a* may be tied together and coupled to an impedance of particular magnitude, and differential inputs of the second integrator 104*b* may be tied together and coupled to an impedance of similar particular magnitude, so both the first integrator 104*a* and the second integrator 104*b* see a similar input load 110. Additionally, since the passive output load 108*b* may be selected so as to exhibit an impedance similar to that of the active output load 108*a* as discussed above, the integrator module 114 may be configured and arranged so that both the input load 110 and the output load of both the first integrator 104*a* and the second integrator 104*b* in the Pre-Start State may appear to be balanced and constant in time. Such an implementation, for example, may be beneficial or advantageous in many respects, including at least in ways similar to that described above in connection with FIG. 1.

Following block 305, the process 300 may branch to block 310 and block 320. At block 310, one of the first integrator 104*a* and the second integrator 104*b* may be engaged so as to monitor or sample the active input load 110*a*. In general, the Default Monitor State may be defined as desired so that any particular one of the first integrator 104*a* and the second integrator 104*b* may be selected to monitor or sample the active input load 110*a* at block 310. For example, the Default Monitor State may be defined so that the first integrator 104*a* is engaged to the Active State so as to monitor or sample the active input load 110*a*, and the second integrator 104*b* is engaged to the Reset State so as to not monitor or sample the active input load 110*a* and/or be coupled with the passive input load 110*b*. Other embodiments are possible.

At block 320, the one of the first integrator 104*a* and the second integrator 104*b* engaged to monitor or sample the active input load 110*a* may itself be monitored, to determine when the particular integrator currently in the Active State is to be switched with the particular integrator currently in the Reset State, so that the latter may be switched to monitor or sample the active input load 110*a*. As discussed above in connection with FIG. 1, this switching may be based upon any of a number of one or more particular criteria. Whether or not particular criterion is met may be determined at decision block 325.

For example, at block 325, a determination may be made as to whether the particular integrator currently in the Active State has been in this State of operation for a particular predetermined time period. The particular predetermined period of time, for example, may be 10 ns, 100 ns, 1 ms, 10 ms, 100 ms, 1 s, 10 s, etc. In another example, at block 325, a determination may be made as to whether the particular integrator currently in the Active State is at, is near, or has exceeded maximum allowable integration error.

The integration error, for example, may the product of a respective integrator's RC time constant with the integrators error signal. The integrators error signal may be the amount the integrator's output deviates from the output that would be expected from a perfect and/or ideal integrator. In some embodiments, the average integration error may be measured prior to use of the integrator, and can be thought of as a property of the integrator. Thus, after a predetermined amount of run time, the typical integration error may be known based on the average integration error. Alternatively or additionally, if the correct shape/amplitude of the output signal is known (e.g., from a test signal with a known shape) then comparing the actual output of the integrator with that expected would provide a measure of the integration error. Alternatively or additionally, two or more integrators could be operated together, with one receiving the input signal, and the other a dummy signal, where the dummy input was as close to possible as the real signal, except lacking the signal. In this embodiment, the output of the integrator(s) receiving the dummy signal would provide a direct measure of the likely integration error on the integrator receiving the real signal, and this information could be used to determine how long the integrator receiving the real signal remained active.

As another example, at block 325, the rate of the input signal and/or the output signal may be monitored. If the rate of change of the input signal is greater than a given threshold value then the switching frequency may be increased. If the rate of change of the input is less than a given threshold value then the switching frequency may be decreased. As another example, the switching frequency may be a function of the rate of change of the input signal and/or the output signal.

In these and other embodiments, process flow within the process 300 may branch back to block 320 upon a determination at block 325 that particular switching criterion has not been met. However, process flow within the process 300 may branch to block 315 upon a determination at block 325 that particular switching criterion has been met.

At block 315, the integrator module 114 may be switched from the Default Monitor State to an Alternate Monitor State so that the other one of the first integrator 104*a* and the second integrator 104*b* may be selected to monitor the input load 110 of FIG. 1. For example, the Alternate Monitor State may be defined so that the second integrator 104*b* is engaged to the Active State so as to monitor the active input load 110*a*, and the first integrator 104*a* is engaged to the Reset State so as to not monitor the active input load 110*a*. Other embodiments are possible.

Following block 315, flow within the process 300 may branch back to block 310 and block 320. In this manner, continuous switching may be achieved as desired between the first integrator 104*a* and the second integrator 104*b* to monitor the input load 110 of FIG. 1. The continuous switching between the first integrator 104*a* and the second integrator 104*b* may be implemented based on whether or not one or more switching criteria are met.

Figure 4:
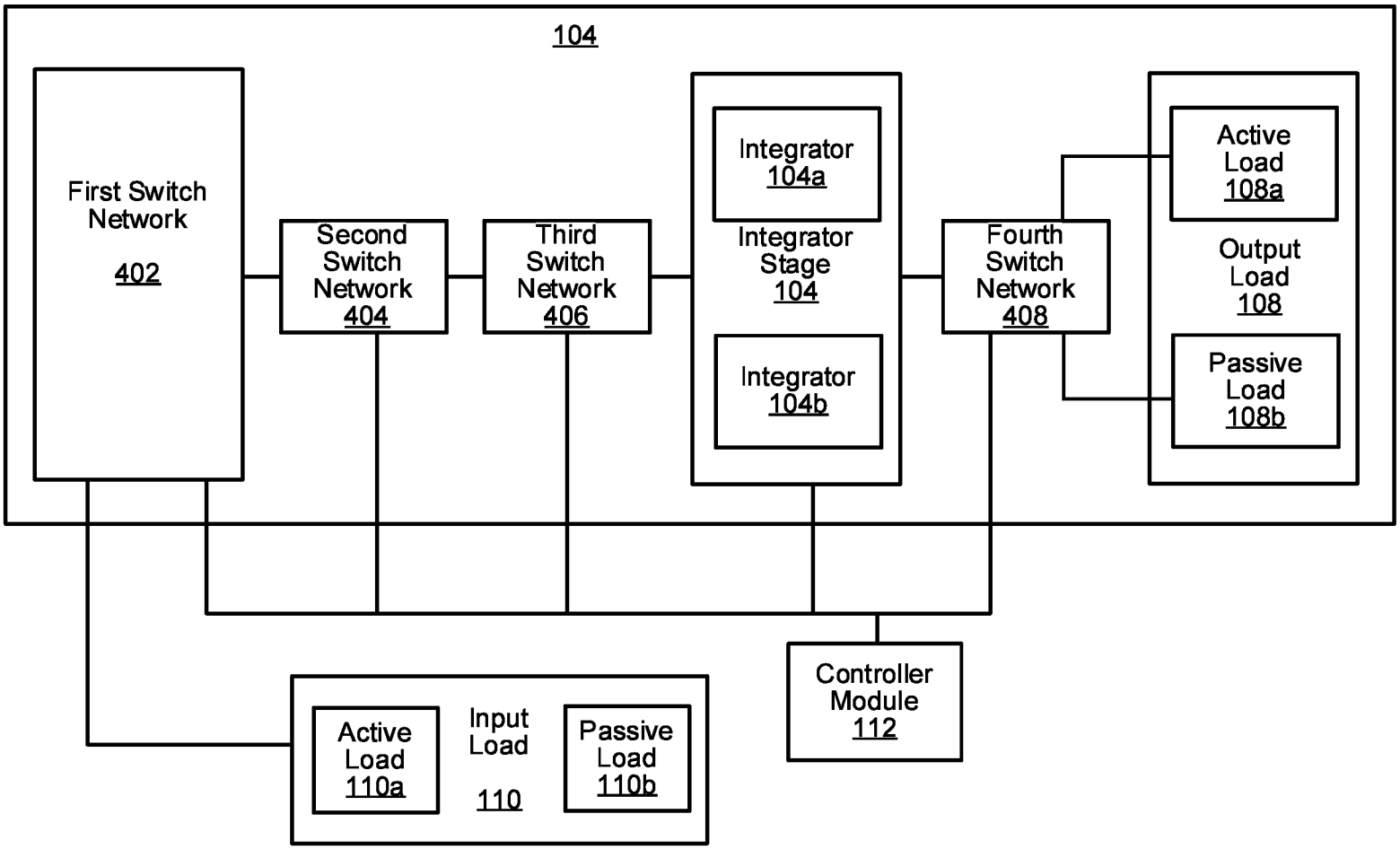
FIG. 4 illustrates a block diagram of an integrator system according to some embodiments described herein.

FIG. 4 illustrates the integrator module 114, the controller module 112, and the input load 110 of FIG. 1. In some embodiments, the integrator module 114 may include the integrator stage 104 and the output load 108 as shown in FIG. 1, as well as a first switch network 402, a second switch network 404, a third switch network 406, and a fourth switch network 408. The integrator stage 104 may include the first integrator 104*a* and the second integrator 104*b*; the output load 108 may include the active output load 108*a* and the passive output load 108*b*. Other embodiments are possible than that shown in FIG. 4, and further such embodiments may be implementation-specific, similar to that discussed above in connection with other embodiments described herein.

The controller module 112 may be coupled to at least the integrator stage 104, as well as the first switch network 402, the second switch network 404, the third switch network 406, and the fourth switch network 408. In some embodiments, the controller module 112 may control these respective components or elements to select which one of the first integrator 104*a* and the second integrator 104*b* is coupled to the active input load 110*a* and/or the passive input load 110*b*. When coupled thereto, the active input load 110*a* and/or the passive input load 110*b* may correspond to an input load to the one of the first integrator 104*a* and/or the second integrator 104*b*. When not coupled to the active input load 110*a*, the passive input load 110*b* may correspond to an input load 110 to the one of the first integrator 104*a* and the second integrator 104*b*. In example embodiments, the first switch network 402 may be configured so that when a particular one of the first integrator 104*a* and the second integrator 104*b* is not coupled to the active input load 110*a*, an impedance or load presented by the passive input load 110*b* may be similar to an impedance or load presented by the active input load 110*a*. In this manner, the integrator module 114 may be configured and arranged so that the input load 110 of both the first integrator 104*a* and the second integrator 104*b* during operation or use may appear to be balanced and constant in time. More specifically, regardless of whether or not the first integrator 104*a* and the second integrator 104*b* is coupled to the active input load 110*a* and/or the passive input load 110*b*, the input as seen by the first integrator 104*a* and/or the second integrator 104*b* is substantially or approximately about the same.

Similarly, regardless of whether or not the first integrator 104*a* and the second integrator 104*b* are coupled to the active input load 110*a* and/or the passive input load 110*b*, the output load as seen by the first integrator 104*a* and the second integrator 104*b* is substantially or approximately about the same. In some embodiments, the controller module 112 may be coupled to at least the integrator stage 104, as well as the first switch network 402, the second switch network 404, the third switch network 406, and/or the fourth switch network 408 to select which one of the first integrator 104*a* and/or the second integrator 104*b* is coupled to the active output load 108*a* and/or the passive output load 108*b*. In some embodiments, the passive output load 108*b* may be selected so as to exhibit an impedance similar to that of the active output load 108*a* when coupled to either one the first integrator 104*a* and/or the second integrator 104*b*. In this manner, the integrator module 114 may be configured and arranged so that the output load of both the first integrator 104*a* and the second integrator 104*b* during operation or use may appear to be balanced and constant in time.

As mentioned above, the one of the first integrator 104*a* and the second integrator 104*b* that is currently coupled to both the active input load 110*a* and the active output load 108*a* may be considered to be in the Active State As currently integrating or sampling voltage of the active input load 110*a*. Conversely, the one of the first integrator 104*a* and the second integrator 104*b* that is currently coupled to both the passive input load 110*b* and the passive output load 108*b* may be considered to be in a Reset State As not integrating or sampling voltage of the active input load 110*a*.

Example states of the first switch network 402, the second switch network 404, the third switch network 406, and the fourth switch network 408 of FIG. 4, as well as corresponding states of the first integrator 104*a* and the second integrator 104*b*, is shown in table form as Table 2:

| | Configuration | | | |
|---|---|---|---|---|
| | First Switch Network 402 | Second Switch Network 404 | Third Switch Network 406 | Fourth Switch Network 408 |
| Pre-Start: | | | | |
| Integrator 104a | State A | State A | State A/B | State A |
| Integrator 104b | State A | State A | State A/B | State A |
| Default: | | | | |
| Integrator 104a (Hold) | State B | State B | State A/B | State B |
| Integrator 104b (Stabilize) | State B | State B | State A/B | State B |
| Alternate: | | | | |
| Integrator 104a (Stabilize) | State B | State A | State A/B | State A |
| Integrator 104b (Hold) | State B | State A | State A/B | State A |

Figure 5:
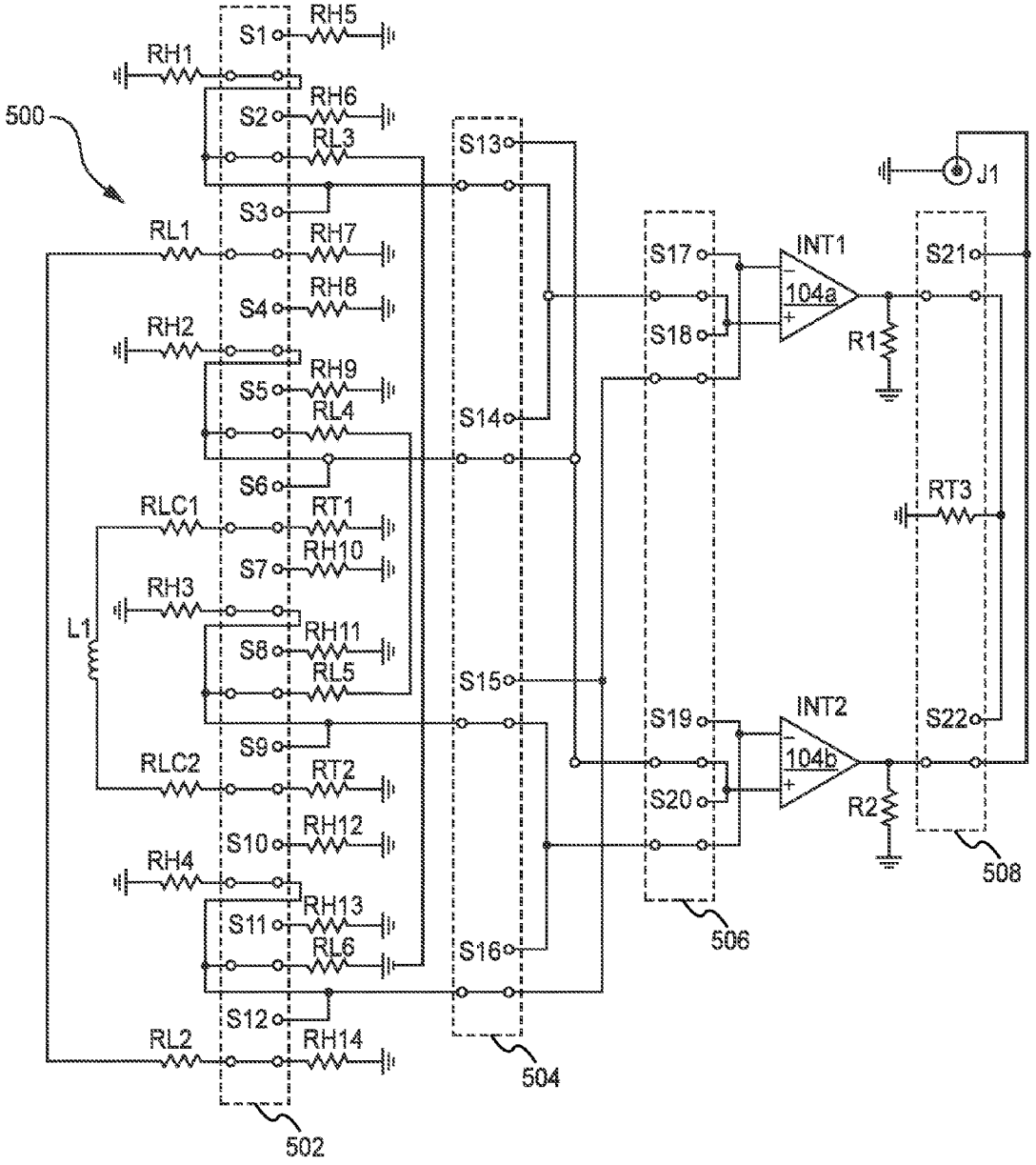
FIG. 5 illustrates an example integrator circuit diagram with a switch arrangement in a first State according to some embodiments described herein.
Figure 6:
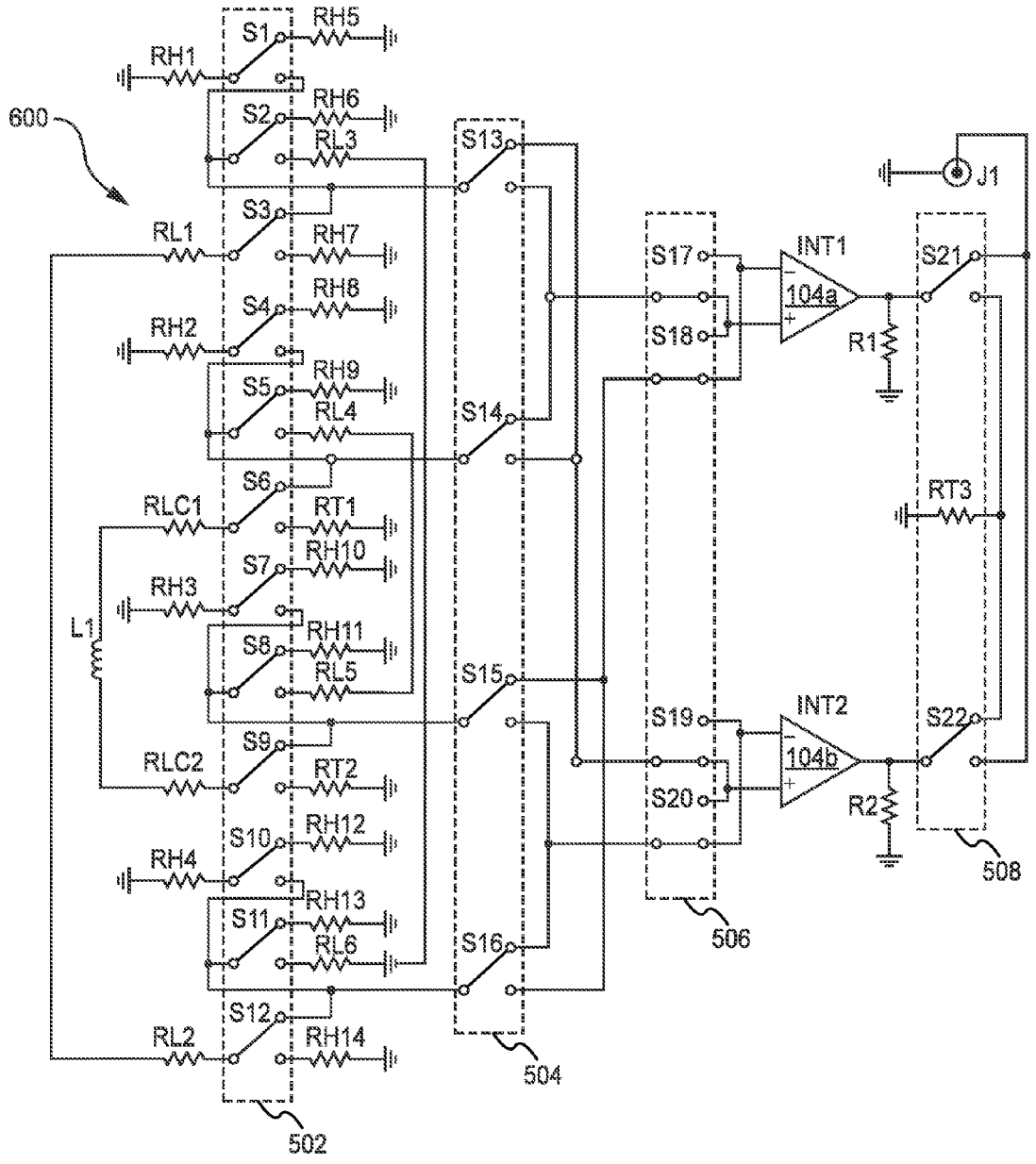
FIG. 6 illustrates the integrator circuit diagram of FIG. 5 with the switch arrangement in a second State according to some embodiments described herein.
Figure 7:
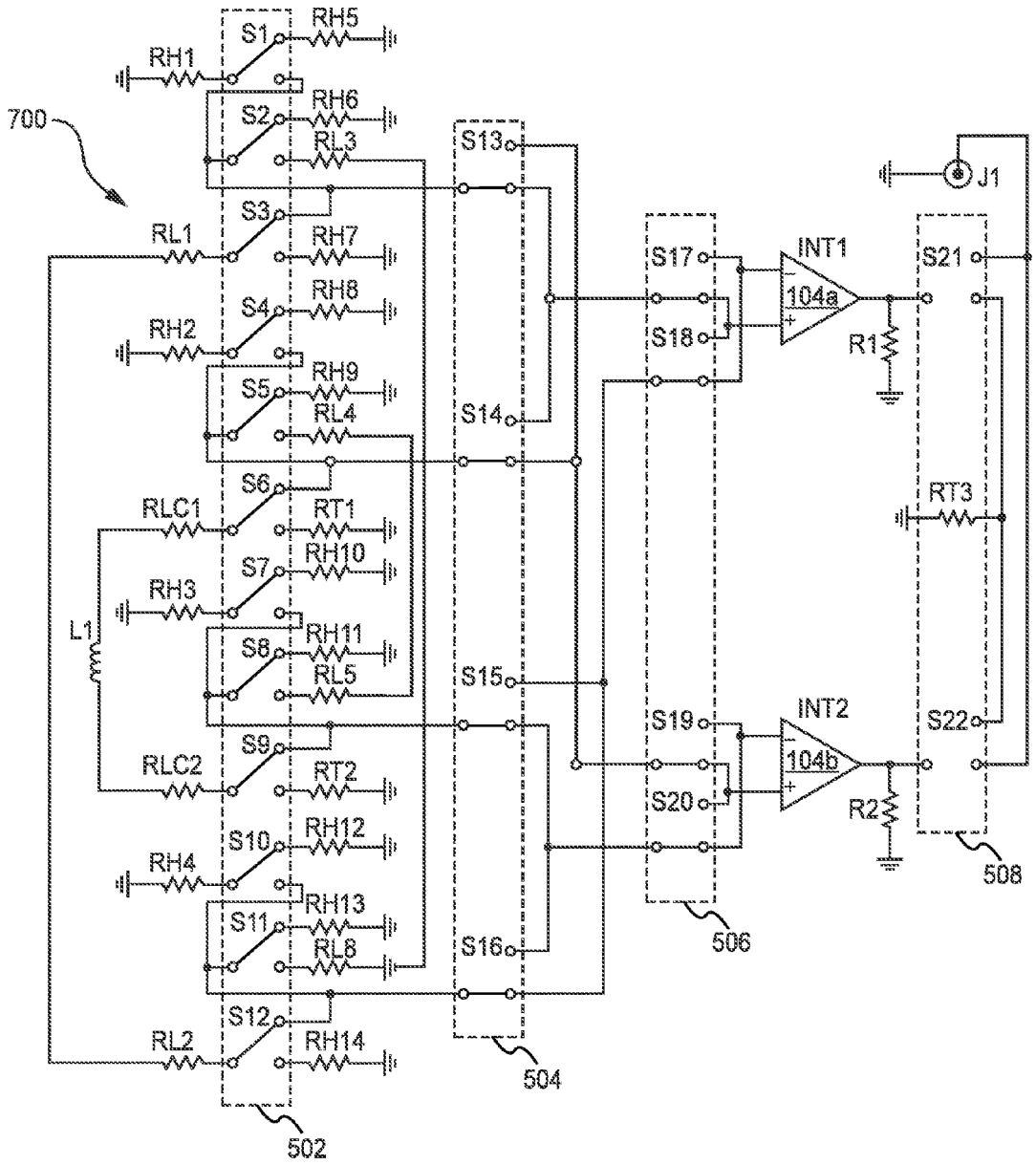
FIG. 7 shows the integrator circuit architecture of FIG. 5 with the switch arrangement in a third State according to some embodiments described herein.

FIGS. 5-7 illustrate examples of circuit diagrams showing various states and/or configurations of a first switch network 502, a second switch network 504, a third switch network 506, and a fourth switch network 508. The various states and/or configurations shown in FIGS. 5-7, for example, may correspond with the states illustrated in Table 2.

FIG. 5, for example, shows an example of an integrator circuit architecture 500 with a switch arrangement in a first State or condition as shown in accordance with the present disclosure. The integrator circuit architecture 500 is one possible implementation of the integrator module 114 of the present disclosure. Many other possible implementations of the integrator module 114 are possible.

In some embodiments, the integrator selector 102 may include the first switch network 502, the second switch network 504, and/or the third switch network 506 among other components. In some embodiments, the output load selector 106 may include the fourth switch network 508.

In reference to Table 2, the first State or condition of the example integrator circuit architecture may be matched with the above-mentioned Pre-Start State or configuration. For example, the first switch network 502 may comprise at least switches S1-S12 and/or resistors RH1-RH14, components RL1, components RL2, the resistor RT1, and/or the resistor RT2 and is shown in State A. In State A, each of switches S1-S12 may be in a similar State or position. The second switch network 504, for example, may comprise switches S13-S16. In State A, each of switches S13-S16 may be in a similar State or position. The third switch network 56, for example, may include switches S17-S20, is shown in State A. In State A, each of switches S17-S20 may be in a similar State or position. As discussed in further detail below, the State of the third switch network 506 does not affect which one of the first integrator 104*a* and the second integrator 104*b* is coupled to the active input load 110*a*. Rather, the State of the third switch network 506 may affect the polarity of the differential input of the first integrator 104*a* and the second integrator 104*b* as referenced to the active input load 110*a*. The fourth switch network 508, for example, may include switches S21-S22 is shown in State A. In State A, each of switches S21-S22 may be in a similar State or position.

In FIG. 5, for example, the active input load 110*a* may modeled by the inductor L1, components RLC1, and/or components RLC2; the passive input load 110*b* is modeled by components RL1 and components RL2; the active output load 108*a* is modeled by resistor R1 and component J1; and the passive output load 108*b* is modeled by resistor R2 and the resistor RT3.

FIG. 6, for example, shows an example integrator circuit architecture 600 with a switch arrangement in a second State or condition as shown in accordance with the present disclosure. In reference to Table 2, the second State or condition of the integrator circuit architecture 600 may be matched with the above-mentioned Default Monitor State or configuration. In particular, the first switch network 502 is shown in State B whereby each of switches S1-S12 may be in a similar State or position. Similarly, the second switch network 504 is shown in State B whereby each of switches S13-S16 may be in a similar State or position. Further, the third switch network 506, comprising switches S17-S20, is shown in State A whereby each of switches S17-S20 may be in a similar State or position. Still further, the fourth switch network 508 is shown in State B whereby each of switches S21-S22 may be in a similar State or position. In the integrator circuit architecture 600 of FIG. 6, the active input load 110*a* may modeled by the inductor L1, components RLC1, and/or components RLC2; the passive input load 110*b* is modeled by components RL1 and; the active output load 108*a* is modeled by resistor R1 and component J1; and the passive output load 108*b* is modeled by resistor R2 and the resistor RT3.

FIG. 7, for example, shows an example integrator circuit architecture 700 with a switch arrangement in a second State or condition as shown in accordance with the present disclosure. In reference to Table 2, the second State or condition of the integrator circuit architecture 700 may be matched with the above-mentioned Default Monitor State or configuration. In particular, the first switch network 502 is shown in State B whereby each of switches S1-S12 may be in a similar State or position. Similarly, the second switch network 504 is shown in State A whereby each of switches S13-S16 may be in a similar State or position. Further, the third switch network 506, comprising switches S17-S20, is shown in State A whereby each of switches S17-S20 may be in a similar State or position. Still further, the fourth switch network 508 is shown in State A whereby each of switches S21-S22 may be in a similar State or position. In the integrator circuit architecture 700 of FIG. 7, the active input load 110*a* may be modeled by the inductor L1, components RLC1, and/or components RLC2; the passive input load 110*b* is modeled by components RL1 and components RL2; the active output load 108*a* is modeled by resistor R1 and J1; and the passive output load 108*b* is modeled by resistor R2 and the resistor RT3.

Referring now collectively to FIGS. 5-7, in some embodiments, resistors RH1-RH14, for example, may be high value resistors. A high value resistor, for example, may be have any value such as, for example, 10 kΩ, 100 kΩ, 1 MΩ, 10 MΩ or 1 GΩ. In some embodiments, each or resistors RH1-RH14 may have the same resistance value within plus or minus 10% or may include a plurality of resistors and/or other devices with the same resistance value within plus or minus 10%. In some embodiments, each of resistors RH1-RH14 may keep a respective switch pole's electric potential from floating in an undefined manner. In some embodiments, the purpose of a particular switch may be related to charge injection and/or leakage balance during switching, and in many cases the switch may switch between two resistors which are in series with circuit ground.

Switch S1 of the first switch network 502 may be one example. In the pre start condition, as shown in FIG. 5, switch S1 connects switch S2 to ground through the resistor RH1. At the start of operation, as shown in FIG. 6 wherein the first integrator 104*a* is in the Active State, switch S1 switches the resistor RH1 to the resistor RH5, and both the resistor RH1 and the resistor RH5 are connected to ground. Such an implementation may be beneficial or advantageous in many respects. For example, in many cases with respect to switches, there may be a small amount of charge that is injected during switching, such as 10 pC, for example. There may also be a small amount of leakage current through a particular switch at all times, such as +/−5 nA, for example. In accordance with the present disclosure, the switches may be arranged to have both the leakage current and/or the charge injection balanced (or substantially balanced within reasonable manufacturing and/or design constraints) throughout the circuit to eliminate any potential difference at the inputs of the integrator from this noise source to the minimum as possible. Further, such an arrangement may enable the integrator module 114 to operate as a very high-gain integrator for tens of hours while maintaining low drift error.

Components RLC1 and/or components RLC2 may model integrator coil resistance. In FIG. 5, these tie to each other through switch S6 and switch S9 which are then in series with the resistor RT1 and the resistor RT2 to ground in pre-start configuration. In some embodiments, the resistor RT1 and the resistor RT2 may be chosen to match an integrator input impedance so that the inductor L1 sees the same load when it is first switched into one of the first integrator 104*a* and the second integrator 104*b* at start. In some embodiments, components RL1-components RL4 may be chosen to substantially match components RLC1 and/or components RLC2 within, for example, plus or minus 10%. As shown in FIG. 5, both the first integrator 104*a* and the second integrator 104*b* may be connected or coupled to these resistors to simulate the active input load. During operation, the active integrator may be switched into the inductor L1, and the inactive integrator sees a dummy load impedance to the integrator input. The dummy load impedance, for example, may be the same or substantially balanced within reasonable manufacturing and/or design constraints as the active load inductance. As shown in the red and green traces in FIGS. 5-7, this may be observed by starting at one input of an integrator and tracing out the circuit path to the other input. However, it will be appreciated that such indications are not necessary in FIGS. 5-7, as the circuit path starting at one input of a particular integrator to another input of the particular integrator is clearly indicated by nodal connections in FIGS. 5-7.

The various resistors, capacitors, and/or inductors shown in FIGS. 5-7 may represent single components or the combined resistance, capacitance, and/or inductance of one or more components within the circuit or a portion of a circuit.

In some embodiments, the first switch network 502 may switch the integrator loop into the circuit of FIGS. 5-7, and/or switch corresponding balancing switches. As shown in FIG. 5, when the first switch network 502 is in State A, both the first integrator 104*a* and the second integrator 104*b* are connected with components RL1-components RL4 as an input, and the inductor L1 is connected with the resistor RT1 and the resistor RT2.

As shown in FIG. 6 and FIG. 7, when the first switch network 502 is in State B, then the integrator may be plugged into the circuit, along with a dummy load defined by components RL1-components RL4, and both the first integrator 104*a* and the second integrator 104*b* may be switched between these two inputs. When the first switch network 502 is in State B, the second switch network 504 may control which one of the first integrator 104*a* and the second integrator 104*b* is coupled to the active input load 110*a*.

The second switch network 504 alternately switches the first integrator 104*a* and the second integrator 104*b* between the integrator L1 and the dummy components RL load. While one integrator sees the integrator coil and is in the Active State, the other integrator is in the Reset State. The second switch network 504 also preferentially connects integrator outputs to J1, which may correspond to a DAQ output connector (i.e., the active load 110*a*), or a dummy load (i.e., passive output load 108*b*). The dummy load (or dummy input or dummy signal), for example, may include a load that is substantially similar with the active load in resistance, capacitance, and/or inductance but comprises little or no current and/or voltage.

As mentioned above, the third switch network 506 changes the polarity of the signal going into each of the first integrator 104*a* and the second integrator 104*b*. In some embodiments, the third switch network 506 may be run at about half the frequency of the second switch network 504, so that the polarity on each of the first integrator 104*a* and the second integrator 104*b* may alternate during its on state.

In some embodiments, logic as controlled by the controller module 112 to switch the switches of FIGS. 5-7 may be controlled so that respective logic gates are properly used to ensure that the timing is exactly the same to each switch (or substantially the same within reasonable manufacturing and/or design constraints). In some embodiments, this may be accomplished by using extra logic gates to ensure that delays through the devices match exactly or precisely through the circuit.

In some embodiments, the third switch network 506 may be omitted in any of the embodiments described herein.

The low-noise switching of the example integrator module 114 of the present disclosure may enable the integrator module 114 to be a usable long pulse low noise integrator. Another property of the integrator module 114 is using the pairs, or more, of integrators together where one integrator is in the Active State and the other is in the Reset State. In some embodiments, the benefit of the Reset State is that the integrator in reset or stabilize is allowed to fully reset back to zero using a sample and hold circuit. Other benefits may be achieved.

In some embodiments, the integrator module 114 may include sample and hold logic, which may be used to match switching conditions. In some embodiments, to reset an integrator back into stability, the sample and hold circuit may be in reset mode for many integrator RC times. Using just a single integrator to accomplish this may result in losing a large part of the data from the active input load while in the Reset State. The use of two integrators as described herein may minimize the loss of data to only the small amount of time during switching is lost.

Figure 8:
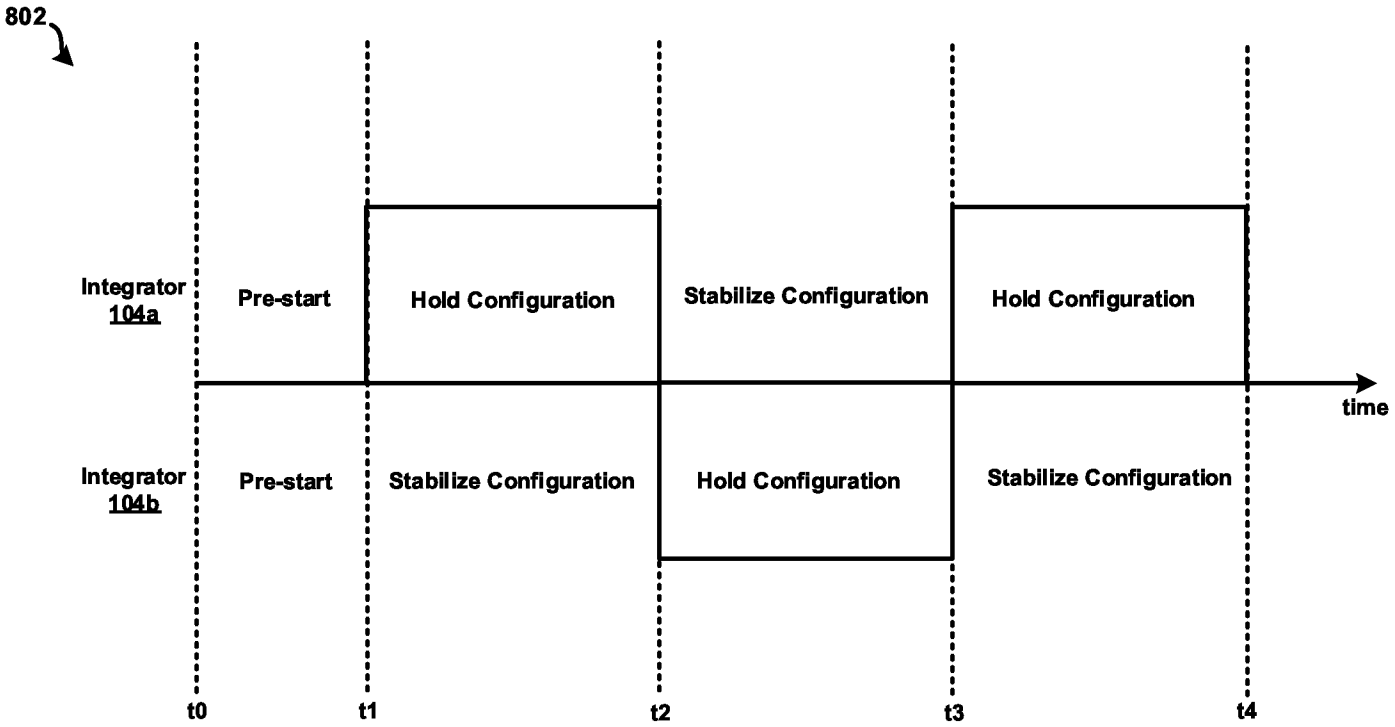
FIG. 8 illustrates an example timing diagram in accordance with the present disclosure.

Referring now to FIG. 8, an example timing diagram 802 is shown in accordance with the present disclosure. Between time t0 and t1, the State or configuration of the first switch network 502, the second switch network 504, the third switch network 506, and the fourth switch network 508 may be such that the first integrator 104*a* and the second integrator 104*b* are in a Pre-Start State. An example of such a configuration is shown in FIG. 5. Between time t1 and t2, the State or configuration of the first switch network 502, the second switch network 504, the third switch network 506, and the fourth switch network 508 may be such that the first integrator 104*a* is in the Active State and the second integrator 104*b* is in the Reset State. An example of such a configuration is shown in FIG. 6. Between time t2 and t3, the State or configuration of the first switch network 502, the second switch network 504, the third switch network 506, and the fourth switch network 508 may be such that the first integrator 104*a* is in stabilize State and the second integrator 104*b* is in the Active State. An example of such a configuration is shown in FIG. 7.

As discussed above, the input load 110 and the output load of the first integrator 104*a* and the second integrator 104*b* may be balanced and constant in time during operation or use, so that a near or about instantaneous switching between the first integrator 104*a* and the second integrator 104*b* may be performed without having to be concerned about transients or settling time. This is shown in FIG. 8. For example, at time t2, a near or about instantaneous switching between the first integrator 104*a* and the second integrator 104*b* may be performed whereby the first integrator 104*a* is placed from the Active State to stabilize State at time t2, and the second integrator 104*b* is changed from the Reset State to the Active State At time t2. Further, while the difference between time t2 and time t1, and time t3 and time t2, and time t4 and time t3 is illustrated in FIG. 8 to be about the same, In some embodiments, the controller module 112 may be configured to select or switch between the first integrator 104*a* and the second integrator 104*b* of the integrator module 114 at any particular interval as desired to monitor the input load 110 of FIG. 1. An example of such preferential switching is discussed above at least in connection with FIGS. 2 and 3.

Figure 9:
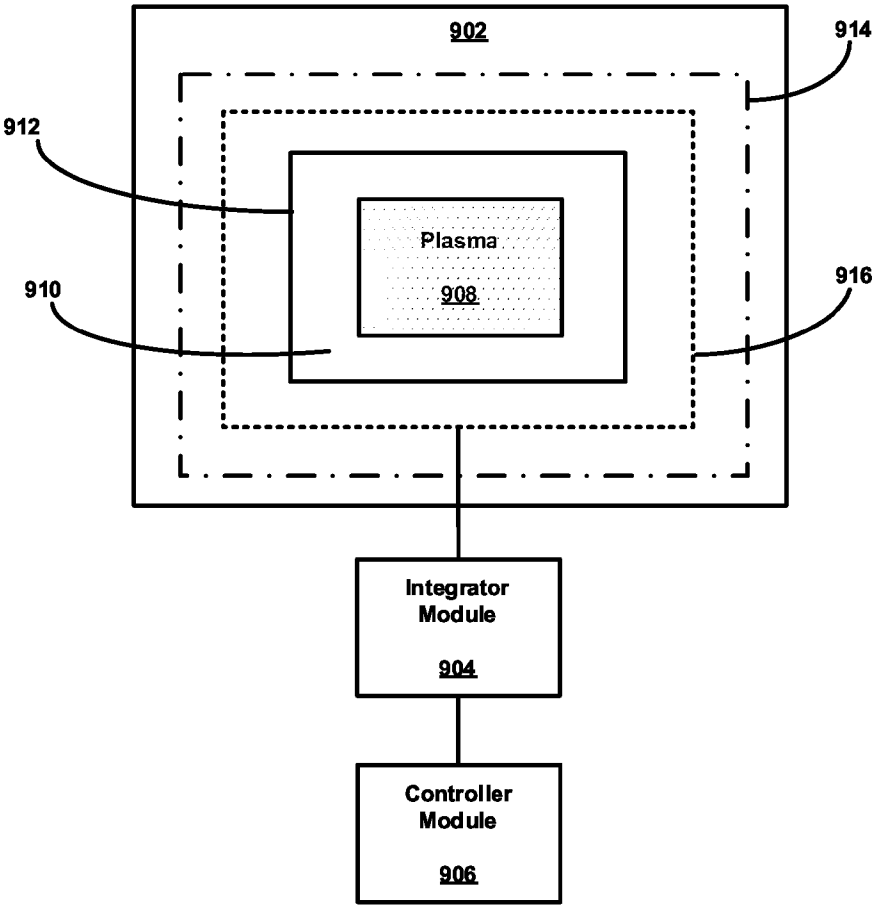
FIG. 9 illustrates an example system in which aspects of the present disclosure may be implemented.

FIG. 9 shows an integrator module 904 and a controller module 906 used in conjunction with an MCFA 902 (Magnetic Confinement Fusion Apparatus) to integrate a signal provided from the MCFA 902 according to some embodiments described herein. The MCFA 902 is described herein as an example of one type of apparatus or system that may be used in conjunction with embodiments described herein. The MCFA 902 may be exchanged with any other device, system, or apparatus from which it may be desired to integrate data.

In general, the MCFA 902 is configured and arranged to generate fusion power using magnetic fields to confine hot fusion fuel in the form of plasma 908. One example of such an apparatus may be based upon the "tokamak" or "tokomak" concept of magnetic confinement, in which the plasma 908 is contained in a donut-shaped vacuum vessel 912. Continuing with this example, a mixture of deuterium and tritium may be heated to temperatures in excess of 150 million degrees centigrade to form the plasma 908. Magnetic fields may be used to form or define a confinement space 910 to keep the plasma 908 away from walls of the vacuum vessel 912 of the MCFA 902. The magnetic fields may be produced by a first set of electromagnetic coils 914 surrounding the vacuum vessel 912, and by a second set of electromagnetic coils 914 (not shown) arranged to drive electrical current through the plasma 908. In use, fusion between deuterium and tritium may produce a charged helium nuclei, a neutron, and some energy. Since the neutron does not carry charge, this particle does not respond to a magnetic field and may freely impact and be absorbed by surrounding walls of the vacuum vessel 912, transferring heat energy to the walls. This heat energy may be dispersed through cooling towers to produce steam and thereby electricity by appropriate methods.

In order to properly maintain the confinement space 910, magnetic flux and field measurements may be obtained with or by the integrator module 904, which is coupled to an MFDA 916 (Magnetic Field Diagnostic Arrangement), which may be controlled by the controller module 906. In the example implementation-specific scenario, the MFDA 916 may comprise of any number of inductive pickup loops or coils. Inductive pickup loops may be preferable due to their non-complex construction, ease of use, and durability, especially when compared to other methods of determining magnetic profiles. Further, inductive pickup loops are capable of extremely high bandwidths, allowing for the measurement of fast magnetic perturbations, requiring microsecond resolution, as well as slow field profiles associated with the more steady State confinement fields.

To convert a voltage measurement from a particular inductive pickup loop of the MFDA 916 to a measurement of magnetic flux and/or field, loop voltage may be integrated by the integrator module 904. However, several factors may make direct integration difficult, especially when there are many orders of magnitude difference between fast and slow magnetic signals, or where high-gain integrators are being used for relatively long integration periods. Although In some embodiments, the integrator module 904 of the present disclosure may be useful or applicable in many different types of applications, the integrator module 904 may address those and other issues in the example implementation-specific scenario. In particular, the integrator module 904 may address issues such as dynamic bandwidth resolution, input offset errors, droop, and long-term drift stability. And, in the example scenario of FIG. 1, the integrator module 114 may be used in multiple regimes of interest such as: (1) the short timescale (<<1 second) ICC (Innovative Confinement Concepts) and small scale concept exploration experiments; and (2) the long pulse (>>1 second) experiments such as DIII-D, NSTX (National Spherical Torus Experiment), and ITER. In this manner, the integrator module 904 may support both small-scale concept exploration and long-pulse fusion experiments. Some characteristics of the integrator module 904 may include: Capable of operation in both short and long-pulse regimes; high frequency response (>5 MHz) for fast time scale resolution; large dynamic range with selectable gain; long-pulse stability, exceeding ITER specification for integration error; real-time output for dynamic control and stabilization for long-pulse applications; low cost: may not cost more than DAQ per channel cost.

Figure 10:
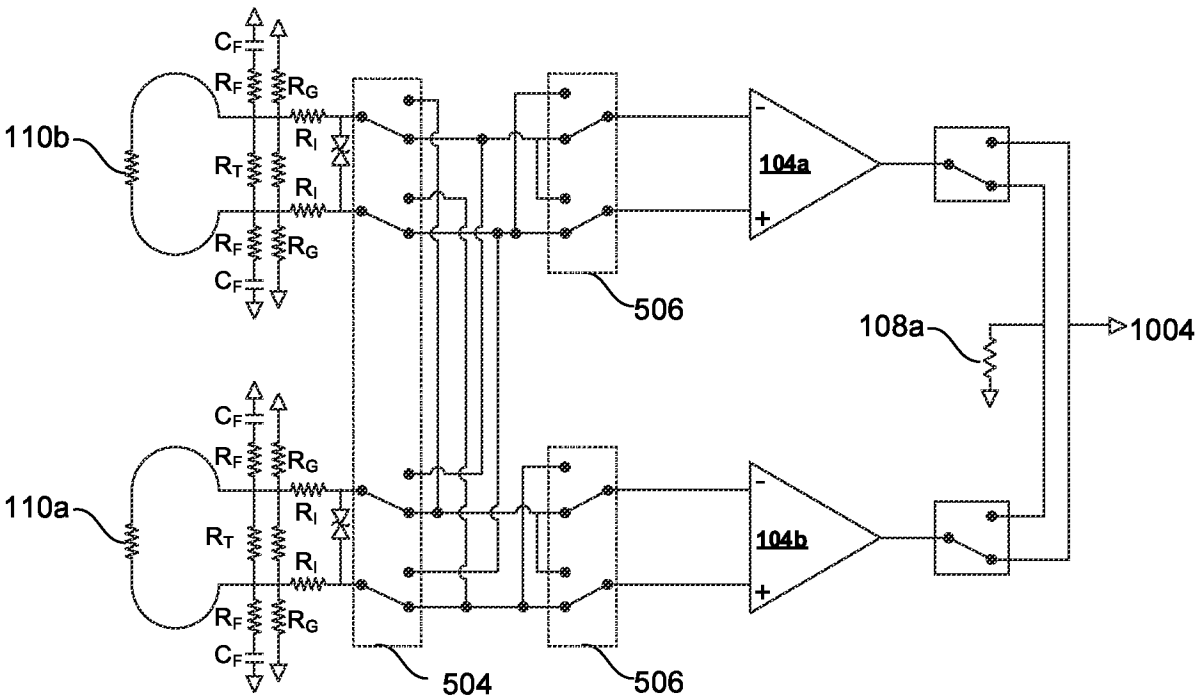
FIG. 10 illustrates another example integrator circuit diagram according to some embodiments described herein.

FIG. 10 illustrates another example integrator circuit diagram 1000 according to some embodiments described herein. Circuit diagram 1000 illustrates the first integrator 104*a* and the second integrator 104*b* as well as a number of switch networks including: second switch network 504, third switch network 506 and fourth switch network 508. Circuit diagram 1000 also includes active input load 110*a* and passive input load 110*b*. A number of resistors, capacitors and/or other components are also illustrated.

Figure 11:
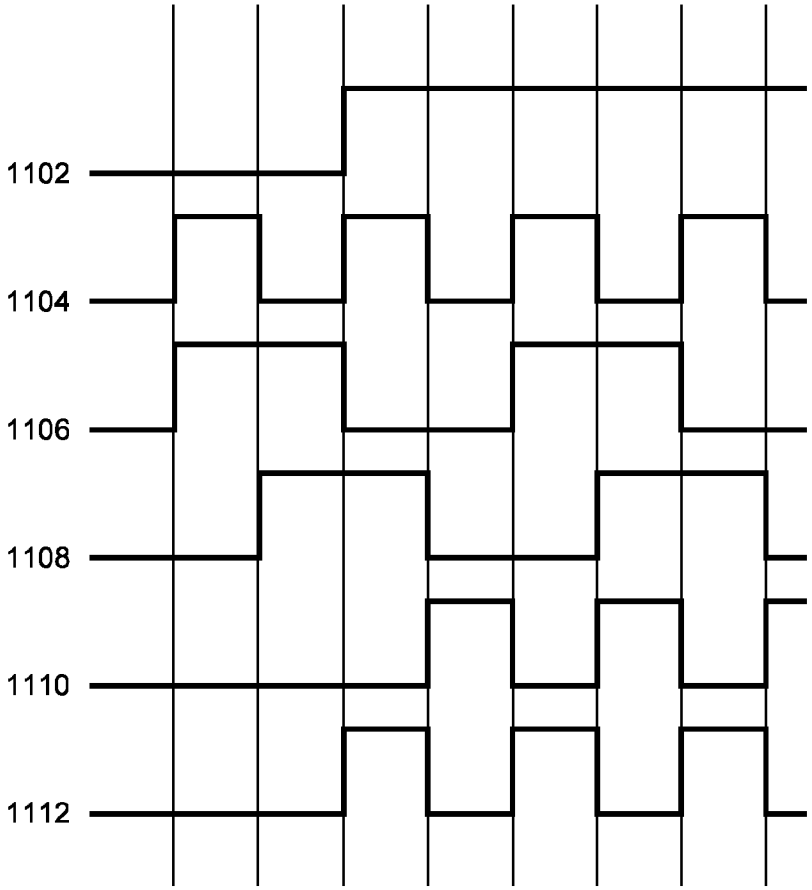
FIG. 11 illustrates a timing diagram according to some embodiments described herein.

FIG. 11 illustrates a timing diagram 1100 for the integrator circuit diagram 1000 shown in FIG. 10 according to some embodiments described herein. Various other timing diagrams may be used and/or various alterations to the current timing diagram may be used. The signals shown in the timing diagram 1100 may be sent from controller module 112 or another controller.

According to the timing diagram, an enable signal 1102 may be required to be in the asserted State (or high) in order for the integrator circuit to integrate the input signal. A control signal 1104 may be coupled with the first switch network 504 and the third switch network 508. The control signal 1104, for example, may control whether the first integrator 104*a* or the second integrator 104*b* is coupled with the active input load 110*a* or the passive input load 110*b*. The control signal 1104, for example, may also control whether the first integrator 104*a* or the second integrator 104*b* is coupled with the passive output load or the data acquisition unit 1004.

The control signal 1106 may control the polarity of the first integrator 104*a* and the control signal 1108 may control the polarity of the second integrator 104*b*. By alternately changing the polarity of the first integrator 104*a* and the second integrator 104*b* each integrator may further compensate for drift by driving drift in opposite directions in alternate polarity configurations of the integrators. For example, an asserted the control signal 1106 may result in a one polarity configuration of the first integrator 104*a* and an unasserted the control signal 1106 may result in an opposite polarity configuration; and an asserted the control signal 1108 may result in a one polarity configuration of the second integrator 104*b* and an unasserted the control signal 1108 may result in an opposite polarity configuration.

The control signal 1110 may switch the first integrator 104*a* between the Active State and the Reset State. The control signal 1112 may switch the second integrator 104*b* between the Active State and the Reset State.

As shown in the timing diagram 1100 and in the circuit diagram 1000, the first integrator 104*a* may be in the Active State with a positive polarity while the second integrator 104*b* is in the Reset State. After a predetermined period of time, the first integrator 104*a* may be in the Reset State while the second integrator 104*b* is in the Active State with a positive polarity. After a predetermined period of time, the first integrator 104*a* may be in the Active State with a negative polarity while the second integrator 104*b* is in the Reset State. After a predetermined period of time, the first integrator 104*a* may be in the Reset State while the second integrator 104*b* is in the Active State with a negative polarity. In this way the integrators alternate the integration between positive and negative polarities.

In some embodiments the controller module 112 may produce the signals shown in the timing diagram 1100. The controller module 112 may include data acquisition, an analog-to-digital converter, a PXIe system, a host computer, and/or real-time signal processing components. For example, these components may include an FPGA card (e.g., NI-7962R) in a PXIe system that may provide an enable signal (e.g. enable signal 1102 in FIG. 11), and a clock signal (e.g., the control signal 1104 in FIG. 11) to an adapter module (e.g., NI 5751). The adapter module may include digital outputs that can send a signal to the integrator(s) 104*a* and/or 104*b*. The adapter module may also include an analog-to-digital converter (ADC), which may be used to digitize the signal received from the integrators 104*a* and/or 104*b* and/or may send a digital stream of data to the FPGA for signal processing. The processed data may be sent from the FPGA to a host computer via the PXIe bus. The host computer may store the digital data. The host computer may also setup and/or control the various parameters of the FPGA code such as, for example, the pre-trigger length, trigger length, clock signal length, and/or number of samples per second, etc.

In some embodiments, the FPGA code may be divided into three single-cycle timed loops and may operate at an IO clock speed (e.g., 50 MHz). The first loop, for example, may control the digital outputs such as, for example, the control signal 1104, the control signal 1106 and/or the control signal 1108, and/or may acquire data from the ADC. The first loop, for example, may normally be in standby mode waiting for a trigger from the host machine. Once triggered via the PXIe backplane, the counters begin, which controls the pre-trigger length, the trigger length, the various control signals shown in FIG. 11, the ADC sampling period, and ADC initial sampling delay from the trigger. The timing of the ADC sampling can be carefully controlled to ensure that the ADC is never sampled while the clock signal is transitioning. Every time the ADC is sampled, the states of the enable signal 1102, the control signal 1104, the control signal 1106 and/or the control signal 1108 may be bundled with data from the ADC and may be set to the first processing loop through a FPGA-scoped FIFO.

The processing loop, for example, may apply offset corrections and/or stitch corrections. The offset correction may remove the DC offset from the signal that is the result of the fact that the integrator is not reset exactly to zero during the hardware reset. By changing the polarity of the first integrator 104*a* and/or the second integrator 104*b* the minus sign in half of the points may be removed. After these corrections, the first point of each cycle may be zero when the clock signal is high (data from the first integrator 104*a*) and the first point of each cycle is zero when the clock signal is low (data from the second integrator 104*b*). The stitch correction may stitch the data together to form a continuous stream so that the first point from second integrator 104*b* is the same as the last point from the first integrator 104*a* in a single the clock signal cycle and so that the first point from the first integrator 104*a* is the same as the last point from second integrator 104*b* during the next period. The states of the second switch network 504, the third switch network 506 and/or the fourth switch network 508 and the processed data points may be re-bundled are transferred to last loop through a second FPGA-scoped FIFO.

The first switch network 502 as shown in FIGS. 5-7 may be used to transition the state of the integrators between their pre/post operation (off) state and their operation/on (on) state. The first switch network 502 may control a series of switches/circuitry/logic. In some incarnations, prior to and following operation, first switch network 502 may isolate the input signal from the integrators and/or to hold the integrators in their Reset State. In some embodiments, during operation The first switch network 502 may allow the integrators to be placed into their active state. In other embodiments, prior to and following operation, first switch network 502 might be used to hold the integrators in their Reset State while during operation first switch network 502 may allow the integrators to be placed into their active state. In some embodiments first switch network 502 may control a series of switches/circuitry/logic with the property that when switched, the input impedance seen by an input signal looking into the integrator does not change, and the input impedance as seen by the first integrator 104*a* and the second integrator 104*b* regardless of the configuration or state of any of the other switches. does not change.

The second switch network 504 as shown in FIGS. 5-7 and 10 may be used to select which integrator sees the real input load/signal, which integrator sees the dummy input load/signal, and which integrator outputs a signal to the real load (e.g., DAQ), and/or which integrator outputs a signal to a dummy load. The second switch network 504 controls a series of switches/circuitry/logic. In some embodiments, the switches/circuitry/logic as part of the second switch network 504 may have the property that the action of the second switch network 504 causes no apparent change in the input impedance seen by the integrators or the input impedance seen by the input load/signal. In some embodiments, the switches/circuitry/logic controlled by the second switch network 504, which may have the property that the action of the second switch network 504 causes no apparent change in the output impedance seen by the integrators or the impedance seen by the output load (e.g., DAQ) looking into the integrators. A single integrator system and/or collection of integrators may contain multiple instances of the second switch network 504, each of which may be independently operated.

The third switch network 506 as shown in FIGS. 5-7 and 10 may be activated to invert the polarity of the signals passing into the first integrator 104*a* and the second integrator 104*b*. The third switch network 506 may control a series of switches/circuitry/logic. In some embodiments, the third switch network 506 may have the property that the action of the third switch network 506 causes no apparent change in the input impedance seen by the integrators or the input impedance seen by the input load/signal. A single integrator system and/or collection of integrators may contain multiple instances of the third switch network 506, each of which may be independently operated.

FIG. 12 shows an example computer system (or device) 1200 in accordance with the present disclosure. For example, the controller module 906 may be implemented with the computer system 1200. An example of a computer system or device includes an enterprise server, blade server, desktop computer, laptop computer, tablet computer, personal data assistant, smartphone, controller, and/or any other type of machine configured for performing calculations. The computer system 1200 may be wholly or at least partially incorporated as part of any previously-described features or elements of the present disclosure, such as the integrator module 114 and the controller module 112 as described above. The example computer system 1200 may be configured to perform and/or include instructions that, when executed, cause the computer system 1200 to wholly or at least partially implement or perform the methods of FIGS. 2 and 3.

The computer system 1200 is shown comprising hardware elements that may be electrically coupled via a bus 1202, or may otherwise be in communication by a hardwired and/or wireless connection as appropriate. The hardware elements may include a processing unit with at least one processor 1204 that may include, without limitation, one or more general-purpose processors and/or one or more special-purpose processors (such as digital signal processing chips, graphics acceleration processors, and/or the like); one or more input devices 1206, which can include, without limitation, a remote control, a mouse, a keyboard, and/or the like; and one or more output devices 1208, which can include, without limitation, a presentation device (e.g., television), a printer, and/or the like.

The computer system 1200 may further include and/or be in communication with at least one non-transitory storage device 1210, which may comprise, without limitation, local and/or network accessible storage, and/or can include, without limitation, a disk drive, a drive array, an optical storage device, a solid-State storage device, such as a random access memory, and/or a read-only memory, which can be programmable, flash-updateable, and/or the like. Such storage devices may be configured to implement any appropriate data stores, including, without limitation, various file systems, database structures, and/or the like.

The computer system 1200 might also include a communications subsystem 1212, which can include, without limitation, a modem, a network card (wireless or wired), an infrared communication device, a wireless communication device, and/or a chipset (such as a Bluetooth™ device, a Wi-Fi device, a WiMax device, cellular communication facilities (e.g., GSM, WCDMA, LTE, etc.), and/or the like. The communications subsystem 1212 may permit data to be exchanged with a network (such as the network described below, to name one example), other computer systems, and/or any other devices described herein. In many embodiments, the computer system 1200 will further comprise a working memory 1214, which may include a random access memory and/or a read-only memory device, as described above.

The computer system 1200 also can comprise software elements, shown as being currently located within the working memory 1214, including an operating system 1216, device drivers, executable libraries, and/or other code, such as one or more application programs 1218, which may comprise computer programs provided by various embodiments, and/or may be designed to implement methods, and/or configure systems, provided by other embodiments, as described herein. By way of example, one or more procedures described with respect to the method(s) discussed above, and/or system components might be implemented as code and/or instructions executable by a computer (and/or a processor within a computer); in an aspect, then, such code and/or instructions can be used to configure and/or adapt a general-purpose computer (or other device) to perform one or more operations in accordance with the described methods.

A set of these instructions and/or code might be stored on a non-transitory computer-readable storage medium, such as the storage device(s) 1210 described above. In some cases, the storage medium might be incorporated within a computer system, such as the computer system 1200. In other embodiments, the storage medium might be separate from a computer system (e.g., a removable medium, such as flash memory), and/or provided in an installation package, such that the storage medium can be used to program, configure, and/or adapt a general-purpose computer with the instructions/code stored thereon. These instructions might take the form of executable code, which is executable by the computer system 1200 and/or might take the form of source and/or installable code, which, upon compilation and/or installation on the computer system 1200 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 1200) to perform methods in accordance with various embodiments of the invention. According to a set of embodiments, some or all of the procedures of such methods are performed by the computer system 1200 in response to the processor 1204 executing one or more sequences of one or more instructions (which might be incorporated into the operating system 1216 and/or other code, such as an application program 1218) contained in the working memory 1214. Such instructions may be read into the working memory 1214 from another computer-readable medium, such as one or more of the storage device(s) 1210. Merely by way of example, execution of the sequences of instructions contained in the working memory 1214 may cause the processor(s) 1204 to perform one or more procedures of the methods described herein.

The terms "machine-readable medium" and "computer-readable medium," as used within the present disclosure, may refer to any non-transitory medium that participates in providing data that causes a machine to operate in a specific fashion. In an embodiment implemented using the computer system 1200, various computer-readable media might be involved in providing instructions/code to the processor(s) 1204 for execution and/or might be used to store and/or carry such instructions/code. In many implementations, a computer-readable medium is a physical and/or tangible storage medium. Such a medium may take the form of a non-volatile media or volatile media. Non-volatile media may include, for example, optical and/or magnetic disks, such as the storage device(s) 1210. Volatile media may include, without limitation, dynamic memory, such as the working memory 1214.

Example forms of physical and/or tangible computer-readable media may include a floppy disk, a flexible disk, hard disk, magnetic tape, or any other magnetic medium, a CD-ROM, any other optical medium, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 1204 for execution. By way of example, the instructions may initially be carried on a magnetic disk and/or optical disc of a remote computer. A remote computer might load the instructions into its dynamic memory and send the instructions as signals over a transmission medium to be received and/or executed by the computer system 1200.

The communications subsystem 1212 (and/or components thereof) generally will receive signals, and the bus 1202 then might carry the signals (and/or the data, instructions, etc. carried by the signals) to the working memory 1214, from which the processor(s) 1204 retrieve and execute the instructions. The instructions received by the working memory 1214 may optionally be stored on the non-transitory storage device 1210 either before or after execution by the processor(s) 1204.

The computer system 1200 is one example of system that may be used to perform embodiments described herein. Various other devices and/or components may be used in place of or in conjunction with the computer system 1200. For example, an integrated circuit, microcontroller, and/or a field-programmable gate array (FPGA) may be used.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art.

That which is claimed:

1. An integrator circuit comprising:

an active input having a first resistance, a first inductance, and a first capacitance;

a passive input, having a second resistance, a second inductance, and a second capacitance, wherein the first resistance is substantially similar to the second resistance, the first inductance is substantially similar to the second inductance, and the first capacitance is substantially similar to the second capacitance;

a first integrator having a first integrator input and a first integrator output, wherein there is no feedback loop between the first integrator input and the first integrator output;

a second integrator having a second integrator input and a second integrator output, wherein there is no feedback loop between the second integrator input and the second integrator output;

a first plurality of switches coupled with and configured to switch the first integrator input between the active input and the passive input, and coupled with and configured to switch the second integrator input between the active input and the passive input;

a second plurality of switches coupled with the first integrator output and the second integrator output; and a controller coupled with the first plurality of switches and the second plurality of switches, configured to control the operation of the first plurality of switches to switch the active input between the first integrator input and the second integrator input, and configured to control the operation of the first plurality of switches to switch the passive input between the first integrator input and the second integrator input.

2. The integrator circuit according to claim 1, wherein the first plurality of switches are configured to switch the first integrator input between the active input and the passive input, and wherein the first plurality of switches are configured to switch the second integrator input between the active input and the passive input.

3. The integrator circuit according to claim 1, wherein the controller, the first plurality of switches, and the second plurality of switches comprise a field-programmable gate array.

4. The integrator circuit according to claim 1, further comprising:

an active output; and a passive output, wherein the controller is configured to control the operation of the second plurality of switches to switch the first integrator output between the active output and the passive output, and wherein the controller is configured to control the operation of the second plurality of switches to switch the second integrator output between the active output and the passive output.

5. The integrator circuit according to claim 4, wherein the controller is further configured to control the operation of the first plurality of switches to switch the active input between the first integrator input and the second integrator input at the same time as controlling the operation of the second plurality of switches to switch the active output between the first integrator output and the second integrator output.

6. The integrator circuit according to claim 4, wherein the controller is further configured to periodically control the operation of the first plurality of switches to switch the active input between the first integrator input and the second integrator input and periodically control the operation of the second plurality of switches to switch the active output between the first integrator output and the second integrator output.

7. The integrator circuit according to claim 1, wherein the controller is further configured to:

sense an output of the first integrator and/or the second integrator; and determine whether to control the operation of the first plurality of switches and the second plurality of switches based on the output of the first integrator and/or the second integrator.

8. The integrator circuit according to claim 1, wherein the controller is further configured to combine an output of the first integrator and the second integrator.

9. The integrator circuit according to claim 1, wherein the active input and the passive input have substantially similar resistance, inductance, and/or capacitance.

10. A method comprising:

integrating an active input signal from an active input, having a first resistance, a first inductance and a first capacitance, with a first integrator, wherein there is no feedback loop between a first integrator input and a first integrator output;

integrating a passive input signal from a passive input, having a second resistance, a second inductance and a second capacitance, with a second integrator, wherein the passive input signal includes substantially no voltage or current, wherein the first resistance is substantially similar to the second resistance, the first inductance is substantially similar to the second inductance, and the first capacitance is substantially similar to the second capacitance, such that there is no feedback loop between a second integrator input and a second integrator output;

switching a first plurality of switches coupled with and configured to switch the first integrator between the active input signal and the passive input signal and coupled with and configured to switch the second integrator between the active input signal and the passive input signal;

integrating the active input signal with the second integrator; and integrating the passive input signal with the first integrator.

11. The method according to claim 10, wherein the integrating the active input signal with the first integrator further comprises integrating the active input signal with the first integrator while a first integrator output of the first integrator is coupled with an active output; and wherein the integrating the passive input signal with the second integrator further comprises integrating the passive input signal with the second integrator while a second integrator output of the second integrator is coupled with a passive output, wherein the active output and the passive output have substantially similar resistance, inductance, and/or capacitance.

12. The method according to claim 11, further comprising switching a second plurality of switches in conjunction with switching the first plurality of switches, wherein the second plurality of switches are coupled with the active output, the passive output, the first integrator output, and the second integrator output.

13. The method according to claim 10, further comprising determining whether a predetermined period of time has elapsed; and wherein the switching a first plurality of switches occurs in response to the determining whether a predetermined period of time has elapsed.

14. The method according to claim 10, further comprising:

sensing an output of the first integrator and/or the second integrator; and determining whether to control the operation of the first plurality of switches based on the output of the first integrator and/or the second integrator, wherein the switching a first plurality of switches occurs in response to the determining whether to control the operation of the first plurality of switches.

15. The method according to claim 10, further comprising combining an output of the first integrator and the second integrator.

16. A method comprising:

integrating an active input, having a first resistance, a first inductance, and a first capacitance, with a first integrator during a first time period to produce first integration data, wherein there is no feedback loop between a first integrator input and a first integrator output;

integrating a passive input with a second integrator during the first time period, wherein the passive input has a second resistance, a second capacitance and a second inductance, wherein the first resistance is substantially similar to the second resistance, the first inductance is substantially similar to the second inductance, and the first capacitance is substantially similar to the second capacitance, wherein there is no feedback loop between the second integrator input and the second integrator output;

integrating the active input with the second integrator during a second time period to produce second integration data;

integrating the passive input with the first integrator during the second time period;

integrating the active input with the first integrator during a third time period to produce third integration data;

integrating the passive input with the second integrator during the third time period;

integrating the active input with the second integrator during a fourth time period to produce fourth integration data;

integrating the passive input with the first integrator during the fourth time period, such that a first plurality of switches is coupled with and configured to switch the first integrator input between the active input and the passive input, and coupled with and configured to switch the second integrator input between the active input and the passive input; and combining the first integration data, the second integration data, the third integration data, and the fourth integration data to produce integration data of the active input signal over the total time period comprising the first time period, the second time period, the third time period, and the fourth time period, such that a continuous switching between the first integrator and the second integrator is based on a switching criteria being met.

* * * * *